US008383569B2

(12) United States Patent
Schwerter et al.

(10) Patent No.: US 8,383,569 B2
(45) Date of Patent: Feb. 26, 2013

(54) CLEANER COMPOSITION

(75) Inventors: Andrea Schwerter, Monheim (DE); Katja Teusch, Dormagen (DE); Matthias Menzel, Langenfeld (DE)

(73) Assignee: Ecolab USA Inc., St. Paul, MN (US)

( * ) Notice: Subject to any disclaimer, the term of this patent is extended or adjusted under 35 U.S.C. 154(b) by 4 days.

(21) Appl. No.: 13/140,857

(22) PCT Filed: Dec. 24, 2008

(86) PCT No.: PCT/IB2008/055534
§ 371 (c)(1),
(2), (4) Date: Jul. 28, 2011

(87) PCT Pub. No.: WO2010/073067
PCT Pub. Date: Jul. 1, 2010

(65) Prior Publication Data

US 2011/0319312 A1 Dec. 29, 2011

(51) Int. Cl.
*C11D 17/00* (2006.01)

(52) U.S. Cl. ..... 510/424; 510/426; 510/429; 510/495; 510/499; 510/238

(58) Field of Classification Search ..... None
See application file for complete search history.

(56) References Cited

U.S. PATENT DOCUMENTS

| | | | | |
|---|---|---|---|---|
| 5,573,702 | A | 11/1996 | Bonnechere et al. | |
| 5,763,386 | A | 6/1998 | Mondin et al. | |
| 5,994,283 | A | 11/1999 | Durbut et al. | |
| 6,323,171 | B1 | 11/2001 | Fonsny et al. | |
| 6,407,051 | B1 | 6/2002 | Smith et al. | |
| 2009/0264329 | A1 * | 10/2009 | Underwood et al. | 510/109 |

FOREIGN PATENT DOCUMENTS

| | | |
|---|---|---|
| EP | 1 078 031 | 7/2007 |

* cited by examiner

*Primary Examiner* — Necholus Ogden, Jr.
(74) *Attorney, Agent, or Firm* — Andrew D. Sorensen; Amy J. Hoffman

(57) ABSTRACT

A single phase alkaline composition comprising by weight about 10 to about 25 percent of nonionic surfactant blend comprising a ratio of between about 1:1 to about 1:2 of alcohol ethoxylate:fatty alcohol alkoxylate, about 3-10% of at least one water soluble solvent, about 1-10% of a chelant, 2-12% of an alkalinity source, 0.5-2% of an anionic surfactant blend comprised of at least about 40-70% of a sulfosuccinate, the balance being water. Compositions of the invention are useful for removing hydrophobic soils or oils whether they are located on a hard surface or on a linen. A method of cleaning a hard surface is also disclosed comprising the steps of diluting the composition of the invention with water to about 1 to about 3 weight percent, applying the diluted composition to the surface, and wiping the surface, wherein the surface is substantially free of oil or residue and the surface is substantially free of corrosion.

18 Claims, No Drawings

CLEANER COMPOSITION

FIELD OF THE INVENTION

The present invention relates to an all-purpose single phase cleaning composition.

BACKGROUND OF THE INVENTION

A common fault with many hard surface cleaners is that they either have a powerful cleaning performance or good material compatibility. It is rare to find these two characteristics in parallel. With kitchen and bathroom hard surface cleaners it is particularly important to get both of these characteristics in one product. For these products it is important to avoid lime build up while concurrently removing body and/or skin fats, soap, or general soil without corroding surfaces.

Removal of greasy soils in wash rooms is especially important in resort areas such as can be found in southern Europe in tourism areas such as in Spain and Portugal or in the Mediterranean or in the Caribbean where sunscreen removal in bathtubs, shower basins, or wash basins creates cleaning problems. With the advent of "water resistant" and "water proof" sunscreens has arisen a unique soil that has become problematic when trying to clean hard surfaces. Once these "water proof" or "water resistant" creams or oils are removed from the skin, they cling tenaciously to the other surfaces. These other surfaces include hard surfaces found in a bathroom and textiles such as towels. A cleaner would desirably readily remove such tenacious soils yet leave low residue on hard surfaces such as glossy tiles or shiny surfaces to prevent smear effects.

As already mentioned, the hard surface cleaner must remove greasy soils but must also be compatible with the surfaces. In hotel restrooms there are many acid-sensitive materials such as marble, terrazzo, granite, metal sanitary fittings fashioned out of brass, copper, stainless steel, chrome, aluminum, and the like, enameled ware, or various plastics such as polymethylmethhacrylate and polycarbonates that must be considered when choosing a cleaning compound. While a hard surface cleaner needs to be tough enough to remove the tenacious soils created from body lotions, creams, and oils, it must also be gentle so as not to damage these often expensive surfaces found in bathrooms and kitchens alike.

It would be desirable to have a hard surface cleaner with better general cleaning ability, less residue, reduced skin irritation, excellent material compatibility and improved rinsing behavior. This composition would be suitable to remove tenacious sunscreens and body lotions found in hotels in warm weather resorts. Finally, the composition would optionally include a biocide active ingredient to claim sanitizing or disinfectant properties against bacteria according to EN 1240.

Thus, there is real and continuing need in the art for improved compositions that are useful in the cleaning of surfaces, particularly hard surfaces, and more particularly in providing degreasing abilities. There is a real and continuing need in the art for improved hard surface treatment compositions which provide a cleaning benefit and which overcomes one or more of the shortcomings of prior art hard surface cleaning compositions. Particularly, there is a need for further improved hard surface cleaning compositions which are provided in an ultra-concentrated format, are miscible with water, are provided in a single phase, mitigate irritation of the skin and eyes, and are not corrosive to soft metals such as aluminum.

SUMMARY OF THE INVENTION

This invention relates to an improved all-purpose liquid alkaline cleaner that can be in the form of a single phase designed for cleaning hard surfaces and linens and is effective at removing grease soil and/or bath soil and in leaving surfaces with a shiny appearance.

An alkaline single phasic hard surface cleaner composition is provided. It is a superconcentrate optionally used in water at a 1-3% concentration. The composition provides a combination of powerful cleaning as required in sanitary rooms with reduced skin irritation and very good material compatibility. The composition of the invention is especially suitable to remove body fats and sun créme. A preferred pH of a 1-3% dilution in water is between about 7 to 10, or about 8 to 9.

A single phase alkaline composition is provided comprising by weight approximately 2-25% of a first nonionic surfactant, 2-20% of a second nonionic surfactant, 3-10% of at least one water soluble solvent, 1-10% of a chelant, 2-12% of an alkalinity source such as potassium hydroxide, monoethanolamine, alkanolamine, or the like 0.5-20% of an anionic surfactant comprised of 40-70% sulfosuccinicmonoalkylester dissolved in organic solvent represented by the general formula $$O_3S—CH—COOR^1—CH_2—COOR^2$$

wherein $R^1$=a fatty alcohol, a fattyalcoholpolyglycolether, or a alkylphenylpolyglycolether or combinations thereof, and $R^2$=H; and the balance of the composition is comprised of water.

In another embodiment the composition includes about 20 weight % nonionic surfactant(s), about 5 weight % alcohol, about 5 weight % complexing or chelating agent, about 9.5 weight % alkanolamine, about 1 weight % of an anionic surfactant blend. The balance of the composition is water. Optionally, about 1 weight % benzalkoniumchloride is added as an active notified ingredient. Other optional components include about 0.1 weight % perfume and about 0.01 weight % of a colorant or dye.

In another embodiment the composition is comprised of about 20 weight % of a combination of at least one ethoxylate of alkyl polyethylene glycol ethers and at least one alkoxylated alcohol, about 5 weight % isopropanol, about 5 weight % sequestrant, about 9.5 weight % alkanolamine, about 1 weight % of an anionic surfactant blend. The balance of the composition is water.

In another embodiment compositions of the invention comprise from about 15-20% mixture of at least two nonionic surfactants, from about 1-5 weight % alcohol, from about 3-5 weight % complexing agent, from about 5-10 weight % amine, 1-3 weight % of a blend of an anionc surfactant dissolved in organic solvent, from about 0.5-1% benzalkonium chloride (50% concentration), and optionally colorant and/or perfume.

A method of cleaning a hard surface is disclosed comprising the steps of diluting a composition of the invention with water to about 1 to about 3 weight percent, applying the diluted composition to the surface, and wiping the surface wherein the surface is substantially free of oil or residue.

In another embodiment a method of cleaning a hard surface soiled with a hydrophobic soil is disclosed comprising the steps of applying a composition of the invention to the hydrophobic soil, allowing the composition to contact the hydrophobic soil for about 2 to about 5 minutes, and wiping the composition and the hydrophobic soil, wherein the hydrophobic soil is substantially removed from the hard surface and the hard surface is substantially free of corrosion. Such method is useful when the hard surface is comprised of brass, aluminium, copper, chromium plated brass, zinc plated metal, PMMA, polycarbonate, polyacetate, polypropylene, PVC, or ABS. It was surprisingly found that the nonionic surfactants of the invention along with the anionic surfactant blend had a synergistic effect in cleaning greasy soils yet provided a product with good material compatibility. That is, the combination of the nonionic surfactants and the anionic surfactant in specific comparable low concentration was substantially better at cleaning greasy soils than the nonionic surfactants alone or a single nonionic surfactant and the anionic surfactant or as the nonionic surfactants and the anionic surfactant in comparable high concentration.

Due to the strong cleaning performance especially to remove all types of fats, the composition of the invention can be used as a multi purpose kitchen cleaner and degreaser in kitchen areas as well as in restrooms. The composition of the invention is also useful as a detergent for washing linens saturated with oils, fats, or other tenacious soils.

DETAILED DESCRIPTION OF THE INVENTION

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The term "alkyl" refers to a straight or branched chain monovalent hydrocarbon radical having a specified number of carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halogen, for example. Examples of "alkyl" include, but are not limited to, methyl, ethyl, n-propyl, isopropyl, n-butyl, s-butyl, t-butyl, n-pentyl, n-hexyl, 3-methylpentyl, and the like.

The term "alkoxy" refers to a straight or branched chain monovalent hydrocarbon radical having a specified number of carbon atoms and a carbon-oxygen-carbon bond, may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halogen, for example. Examples include methoxy, ethoxy, propoxy, t-butoxy, and the like.

The terms EO, PO, or EO/PO as used herein refer to ethylene oxide and propylene oxide, respectively. EO/PO refers to ethylene oxide and propylene oxide block copolymers.

The term "surfactant" or "surface active agent" refers to an organic chemical that when added to a liquid changes the properties of that liquid at a surface.

As used herein, the term "hard surface" includes showers, sinks, toilets, bathtubs, countertops, windows, mirrors, transportation vehicles, floors, and the like. These surfaces can be those typified as "hard surfaces" (such as walls, floors, bedpans, etc.) or fabric surfaces, e.g., knit, woven, and nonwoven surfaces.

Unless otherwise stated, all weight percentages provided herein reflect the weight percentage of the raw material as provided from the manufacturer. The active weight percent of each component is easily determined from the provided information by use of product data sheets as provided from the manufacturer.

Source of Alkalinity

Soil removal is most commonly obtained from a source of alkalinity used in manufacturing a cleaning composition or degreaser. Sources of alkalinity can be organic, inorganic, and mixtures thereof. Organic sources of alkalinity are often strong nitrogen bases including, for example, ammonia (ammonium hydroxide), amines, alkanolamines, and amino alcohols. Typical examples of amines include primary, secondary or tertiary amines and diamines carrying at least one nitrogen linked hydrocarbon group, which represents a saturated or unsaturated linear or branched alkyl group having at least 10 carbon atoms and preferably 16-24 carbon atoms, or an aryl, aralkyl, or alkaryl group containing up to 24 carbon atoms, and wherein the optional other nitrogen linked groups are formed by optionally substituted alkyl groups, aryl group or aralkyl groups or polyalkoxy groups.

For purposes of the invention, it was found that alkanolamines are useful in combination with the other ingredients of the composition. Typical examples of alkanolamines include monoethanolamine, monopropanolamine, diethanolamine, dipropanolamine, triethanolamine, tripropanolamine and the like. Typical examples of amino alcohols include 2-amino-2-methyl-1-propanol, 2-amino-1-butanol, 2-amino-2-methyl-1,3-propanediol, 2-amino-2-ethyl-1,3-propanediol, hydroxymethyl aminomethane, and the like. In one embodiment monoethanolamine is included in the composition of the invention in an amount from about 2 to about 12 weight percent, from about 3 to about 10 weight percent, or from 4 to about 8 weight percent.

Additional detergency can be obtained from the use of surfactant materials. Typically, anionic or nonionic surfactants are formulated into such detergents with other ingredients to obtain compositions that can be used to form cleaning solutions having substantial soil removal while controlling foam action. A number of optional detergent ingredients can enhance soil removal, but it is believed that primarily soil removal is obtained from the alkalinity source and the anionic and/or nonionic surfactant(s).

Nonionic Surfactants

For the purpose of this patent application, the term "nonionic surfactant" typically indicates a surfactant having a hydrophobic group and at least one hydrophilic group comprising a $(EO)_x$ group, a $(PO)_x$ group, or a $(BO)_z$ group wherein x, y and z are numbers that can range from about 1 to about 100. The combination of a generic hydrophobic group and such a hydrophilic group provides substantial surfactancy to such a composition. Examples of suitable types of nonionic surfactant include the ethoxylates of alkyl polyethylene glycol ethers based on the C10-Guerbet alcohol. Examples of these types of surfactants are available from BASF under the tradename Lutensol®.

Ethoxylates of alkyl polyethylene glycol ethers are present in compositions of the invention in an amount from about 1 to about 30 weight percent, from about 2 to about 25 weight percent, and from about 4 to about 15 weight percent. While it is known to use alcohol ethoxylates such as isotridecanolethoxylate in sanitary cleaners, these sanitary cleaners including such alcohol ethoxylates have always been strongly acidic formulations. It is unusual and unexpected to incorporate such a nonionic surfactant into an alkaline formulation such as those of the present invention.

Compositions of the invention are alkaline and have a pH when diluted in water to a concentration of about 1 to about 3% of greater than about 7. In embodiments of the invention such a dilution in water has a pH of between about 8 and 10.

Nonionic surfactants may include alcohol alkoxylates having EO, PO and BO blocks. Straight chain primary aliphatic alcohol alkoxylates can be particularly useful as non-ionic surfactants. Such alkoxylates are also available from several sources including BASF where they are known as "Plurafac" surfactants. A particular group of alcohol alkoxylates found to be useful are those having the general formula $R^1$—$(OC_2H_4)_k$—OH wherein $R^1$ represents an unbranched or branched alkyl or alkenyl group having 1 to 10 carbon atoms, or in an alternate embodiment from about 4 to 8 carbon atoms and k is 1 to 10 or in an alternate embodiment from about 4 to 9, or 6 to 8.

Although a blend of alcohol alkoxylates and fatty alcohol ethoxylates are preferred, one skilled in the art will recognize that other nonionic surfactants may be incorporated into the compositions of the present invention. Alcohol alkoxylates are present in compositions of the invention in an amount from about 2 up to about 20% by weight, more preferably from about 5 up to about 15%, and most preferably from about 7 up to about 14% by weight.

In one embodiment, the two nonionic surfactants comprising the blend of nonionic surfactants are in a ratio of about 1:1 alcohol ethoxylate:fatty alcohol alkoxylate, in another embodiment, the nonionic surfactants are in a ratio of about 1:2 alcohol ethoxylate:fatty alcohol alkoxylate.

Anionic Surfactants

In addition to non-ionic surfactants, an anionic surfactant or an anionic surfactants admixture or blend is included in the compositions of the invention. The term "anionic surfactant" includes any surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and calcium, barium, and magnesium promote oil solubility. It is believed that sodium is a preferred counter ion of the anionic surfactant admixture blend of the invention. It is believed that sodium as the counter ion provides the highest water solubility for the anionic surfactant admixture or blend. Another component of the anionic surfactant admixture may be an organic water soluble solvent such as more fully described below.

As those skilled in the art understand, anionics are excellent detersive surfactants and are, therefore, favored additions in heavy duty detergent compositions. Anionics are useful additives to compositions of the present invention. Further, anionic surface active compounds are useful to impart special chemical or physical properties other than detergency within the composition. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71 86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants suitable for use in the present compositions include the sulfosuccinates. In particular, the sulfosuccinic mono- and dialkylester of the general composition $O_3S$—CH—$COOR^1$—$CH_2$—$COOR^2$ with $R^1$=C8-18 and $R^2$=H, C8-18. Sulfosuccinicmonolakylesters with $R^1$=fatty alcohol or fatty alcohol polyglycolether or alkylphenylpolyglycolether and $R^2$=H. A particularly desirable sulfosuccinate useful in the present composition is dioctylnatriumsulfosuccinate.

The anionic surfactant is optionally dissolved in an organic solvent. While any organic solvent may be used, a commercially available anionic surfactant useful in the present invention is the ABSOLUTE 120 described more fully below. The ABSOLUTE 120 and ABSOLUTE 128 are anionic surfactants provided in the organic solvent of glycoetheracetate.

An anionic surfactant admixture particularly suited for the present invention is available from Aboleo Ltd located in Houston, Tex. and Grangemouth, UK and sold under the tradename of ABSOLUTE 120. Interestingly, ABSOLUTE 120 is marketed as a microemulsion forming surfactant system even though when added to the composition of the present invention, a microemulsion is not formed. In fact, for purposes of the invention it is preferable if a microemulsion is not formed. It is desirable for the compositions of the invention to be single phasic. With a single phase formula, there is never a concern that the phases will separate. Morever, the composition is useful as is and is readily dilutable in water. The end user also does not need agitate before use to ensure that an emulsion is retained or formed.

A composition of the invention includes from about 0.1 to about 20 weight percent a blend of anionic surfactant dissolved in solvent, from about 0.2 to about 10 weight percent, from about 0.3 to about 5 weight percent.

Solvent

A solvent is useful in the composition of the invention to enhance certain soil removal properties. The compositions of the invention can contain a non-aqueous or aqueous solvent. Preferred solvents are non-aqueous oxygenated solvents. Oxygenated solvents include lower alkanols, lower alkyl ethers, glycols, aryl glycol ethers and lower alkyl glycol ethers. These materials are colorless liquids with mild pleasant odors, are excellent solvents and coupling agents and may be miscible with aqueous use compositions of the invention. Examples of useful solvents include methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether, and others. "Substantially water soluble" solvents are defined as being infinitely or 100% soluble by weight in water at 25 degrees C. "Substantially water insoluble" glycol ether solvents include propylene glycol butyl ether, dipropylene glycol butyl ether, dipropylene glycol propyl ether, tripropylene glycol butyl ether, dipropylene glycol dimethyl ether, propylene glycol phenyl ether, ethylene glycol hexyl ether, diethylene glycol hexyl ether, ethylene glycol phenyl ether, diethylene glycol phenyl ether, and others. "Substantially water insoluble" solvents are defined as 53% by weight or less of solvent is soluble in water at 25 degrees C. Preferred solvents are substantially water-soluble solvents. For reasons of low cost, commercial availability, and solvent strength, isopropanol is a preferred solvent. These preferred solvents help reduce surface tension, help solubilize grease, and help to maintain the cleaner as a stable single phase system.

Compositions of the invention comprise from about 3 to about 10 weight percent organic substantially water-soluble solvent, from about 3 to about 8 weight percent, and from about 3 to about 6 weight percent.

The skilled artisan will appreciate that compositions of the invention may incorporate at least two water-soluble solvents. The first is desirably an alcohol and may be provided as isopropanol in an amount from about 3 to about 10 weight percent. The second is a water-soluble solvent that is part of the anionic surfactant blend or admixture. Due to the de minimus amount of solvent present in the anionic surfactant blend or admixture, it is not itemized as a separate ingredient.

Additional Ingredients

Any number of optional ingredients may be added to the concentrate composition of the invention. If the concentrate will be diluted with hard water, as opposed to soft water, a chelating agent or sequestrant is a desirable optional ingredient. Preservatives, biocide active ingredients such as quaternary ammonium compounds for example, fragrance and dye are examples of further ingredients that are optionally added to the concentrate composition of the invention. These additional optional ingredients are discussed in turn in more detail below.

Sequestrant

The active cleaning compositions of the invention can comprise a polyvalent metal complexing, sequestering or chelating agent that aids in metal compound soil removal and in reducing harmful effects of hardness components in service water. Typically, a polyvalent metal cation or compound such as a calcium, a magnesium, an iron, a manganese, a molybdenum, etc. cation or compound, or mixtures thereof, can be present in service water and in complex soils. Such compounds or cations can comprise a stubborn soil or can interfere with the action of either washing compositions or rinsing compositions during a cleaning regimen. A chelating agent can effectively complex and remove such compounds or cations from soiled surfaces and can reduce or eliminate the inappropriate interaction with active ingredients including the nonionic surfactants and anionic surfactants of the invention. Both organic and inorganic chelating agents are common and can be used. Inorganic chelating agents include such compounds as sodium tripolyphosphate and other higher linear and cyclic polyphosphates species. Organic chelating agents include both polymeric and small molecule chelating agents. Organic small molecule chelating agents are typically organocarboxylate compounds or organophosphate chelating agents. Polymeric chelating agents commonly comprise polyanionic compositions such as polyacrylic acid compounds. Small molecule organic chelating agents include sodium gluconate, sodium glucoheptonate, N-hydroxyethylenediaminetriacetic acid (HEDTA), ethylenediaminetetraacetic acid (EDTA), nitrilotriaacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N-N-diacetic acid trisodium salt (MGDA), and iminodisuccinate sodium salt (IDS). All of these are known and commercially available. Small molecule organic chelating agents also include biodegradable sequestrants having combinations of chelating and hydrotroping functionalities from EDG, MGDA and GLDA-type molecules. Preferred sequestrants include ethanoldiglycine disodium salt (EDG), dicarboxymethyl glutamic acid tetrasodium salt (GLDA), and methylglycine-N-N-diacetic acid trisodium salt (MGDA), due to their biodegradability and their ability to bind easily with hydrotropes to form ultra-compact concentrates.

Compositions of the invention include from about 1 to about 10 weight percent sequestrant or chelant, from about 3 to 8 weight percent, and about 4 to 6 weight percent.

Dyes, Fragrances and Preservatives

Aesthetic enhancing agents such as dye and perfume are also optionally incorporated into the concentrate composition of the invention. Examples of dyes useful in the present invention include but are not limited to liquid and powdered dyes from Milliken Chemical, Keystone, Clariant, Spectracolors and Pylam. In a preferred embodiment, Liquitint Violet 0947 commercially available from Milliken Chemical is used. In embodiments of the invention up to about 0.02 wt % is included, up to about 0.015 wt %, and in other embodiments up to about 0.01 wt %.

Examples of perfumes or fragrances useful in concentrate compositions of the invention include but are not limited to liquid fragrances from J&E Sozio, Firmenich, IFF (International Flavors and Fragrances) and Dullberg. In embodiments of the invention Orange Fragrance SZ-40173 commercially available from J&E Sozio is included up to about 1.0 wt %, up to about 0.5 wt %, up to about 0.4 wt % and up to about 0.3 wt %.

Preservatives are optionally included when the concentrate and use solution pH is not high enough to mitigate bacterial growth in the concentrate, either solid or liquid, on the liquid coated substrate, or in the use solution. Examples of preservatives useful in concentrate compositions of the invention include but are not limited to methyl paraben, glutaraldehyde, formaldehyde, 2-bromo-2-nitropropane-1,3-diol, 5-chloro-2-methyl-4-isothiazoline-3-one, and 2-methyl-4-isothiazoline-3-one. Preservatives can be included up to about 2 wt %, up to about 1 wt % and up to about 0.5 wt %.

Water

It should be understood that the water provided as part of the concentrate can be relatively free of hardness. It is expected that the water can be deionized to remove a portion of the dissolved solids. The concentrate is then diluted with water available at the locale or site of dilution and that water may contain varying levels of hardness depending upon the locale. Although deionized is preferred for formulating the concentrate, the concentrate can be formulated with water that has not been deionized. That is, the concentrate can be formulated with water that includes dissolved solids, and can be formulated with water that can be characterized as hard water.

Service water available from various municipalities has varying levels of hardness. It is generally understood that the calcium, magnesium, iron, manganese, or other polyvalent metal cations that may be present can cause precipitation of the anionic surfactant. In general, because of the expected large level of dilution of the concentrate to provide a use solution, it is expected that service water from certain municipalities will have a greater impact on the potential for anionic surfactant precipitation than the water from other municipalities. As a result, it is desirable to provide a concentrate that can handle the hardness levels found in the service water of various municipalities.

The water of dilution that can be used to dilute the concentrate can be characterized as hard water when it includes at least 1 grain hardness. It is expected that the water of dilution can include at least 5 grains hardness, at least 10 grains hardness, or at least 20 grains hardness.

It is expected that the concentrate will be diluted with the water of dilution in order to provide a use solution having a desired level of detersive properties. If the use solution is required to remove tough or heavy soils, it is expected that the concentrate can be diluted with the water of dilution at a weight ratio of at least 1:1. If a light duty cleaning use solution is desired, it is expected that the concentrate can be diluted at a weight ratio of concentrate to water of dilution of up to about 1:1000. It is expected that the weight ratio of concentrate to water of dilution will be between about 1:1 and about 1:500, between about 1:2 and about 1:450, between about 1:3 and about 1:400, and between about 1:5 and about 1:350. In certain preferred liquid delivery applications, the concentrate can be diluted at a weight ratio of concentrate to water of dilution at about 1:50 to 1:200 by weight.

In embodiments of the invention, the composition of the single phasic cleaner is comprised of about 2 to about 25 weight percent isotridecanolethoxylate C13, 8EO (Lutensol™), about 2 to 20 weight percent fatty alcohol alcoxylate (Plurafac™ LF 120), about 3 to 10 weight percent isopropanol, about 1 to about 10 weight percent sequestrant, and about 0.5 to about 20 weight percent anionic surfactant admixture. Optional ingredients include but are not limited to about 0.5 to about 5 weight percent benzalkonium chloride, about 0.1 to about 1.0 weight percent perfume, and/or about 0.005 to about 0.02 weight percent colorant or dye.

In another embodiment of the invention, the composition of the single phase cleaner is comprised of up to about 60% distilled water, up to about 11% isotridecanolethoxylate C13, 8EO (Lutensol™), up to about 11% fatty alcohol alcoxylate (Plurafac™ LF 120), up to about 5% isopropanol, up to about 5% methylglycine diacetic acid (Trilon™ M), up to about 10% monoethanolamine, up to about 1% anionic surfactant admixture (30-60% anionic surfactant/40-70% glycoletheracetate) (Absolute 120™), up to about 1% alkyldimethyl benzylammoniumchloride (50%), and up to about 0.5% perfume and colorant combination.

EXAMPLES

Cleaning compositions were prepared according to the following formulations shown in Table 1. All components are shown in weight percent. The formulations A through H lack the anionic surfactant blend component.

TABLE 1

| Ingredient | A | B | C | D | E | F | G | H |
|---|---|---|---|---|---|---|---|---|
| DI $H_2O$ | 54 | 53.4 | 55 | 57.5 | 60 | 54 | 54 | 50 |
| Lutensol ® TO 8[1] | 25 | — | 15 | — | 10 | 13 | — | — |
| Emulan ® HRE 50[2] | — | 6 | — | — | — | — | — | — |
| Rewopol SBDO75[3] | — | 9 | — | — | — | — | — | — |
| Texapon LS35[4] | — | 4.4 | — | — | — | — | — | — |
| Lutensol AO11[5] | — | — | — | — | — | — | 13 | 25 |
| Dehypon KE 3447[6] | — | — | — | — | — | 13 | — | — |
| Plurafac LF 120[7] | — | 10 | — | 20 | 10 | — | 13 | — |
| Isopropanol | 5 | 5 | 5 | 5 | 5 | 5 | 5 | 10 |
| Trilon M[8] | 5 | 5 | 5 | 5 | 5 | 5 | 5 | 5 |
| MEA[9] | 10 | 10 | 10 | 10 | 10 | 10 | 10 | 10 |
| Benzalkonium Chloride | 1 | 1 | — | — | — | — | — | — |
| Glucoprotamin | — | — | 10 | 2.5 | — | — | — | — |
| Na Cumolsulfonate | — | 3 | — | — | — | — | — | — |

[1]ethoxylates of alkyl polyethylene glycol ethers based on the C10-Guerbet alcohol from BASF
[2]BASF
[3]Sodium diisooctyl sulfosuccinate from Evonik
[4]Sodium lauryl sulphate from Cognis
[5]oxo alcohol ethoxylates based on predominantly linear alcohols from BASF
[6]Modified fatty alcohol polyglycolether from KemCare of UK
[7]BASF
[8]Methylglycinediacetic acid, trisodium salt from BASF
[9]monoethanolamine The following protocols were used in testing the examples.

Dip Test Method

The Dip Test Method was used to determine the cleaning performance of a cleaning preparation on various surfaces, for example on stainless steel, aluminium, tin, plastic, glass, ceramic, or tile to name a few.

The test surface was first cleaned, degreased, and allowed to dry for 2 hours at ambient conditions. The cleaned specimen was weighed using an analytical balance. The recorded weight equalled the "SPECIMEN WEIGHT." Test soil was applied evenly to one side of the test specimen such that the soil covered approximately 75% of the surface. The soiled specimen was allowed to dry at ambient conditions for about 24 hours or until the surface was dry to the touch. The soiled specimen was then weighed and the weight was recorded as "SPECIMEN WITH SOIL WEIGHT." The difference between the SPECIMEN WITH SOIL WEIGHT and the SPECIMEN WEIGHT equalled the weight of the applied residue or soil.

A cleaning preparation of 900 ml was first placed in a beaker and then transferred to a Dip Test Gadget. A Dip test gadget can be e.g. a 250 ml scaled lab glass or similar. The specimen was then dipped into the cleaning preparation and agitated using a uniform agitation. The dip test was run for 20 minutes or until the specimen was visually clean. If the specimen was not visually clean, the cleaning procedure was repeated without applying additional soil. After cleaning, the specimen sample was dipped 5 times into tap water, then 5 times into room temperature demineralised water, and the sample was allowed to dry for about 2 hours.

Once dry, the cleaned specimen was weighed. The recorded value equalled the "POST-CLEANING SPECIMEN WEIGHT." The weight of the residue remaining on the sample was calculated according to the following formula:

Determination of the remaining residue on the specimen via weight of the difference $$\text{Cleaning Performance } [\%] = \frac{m2 - m3}{m2 - m1} * 100\%$$

$m1$ = SPECIMEN WEIGHT

Unit: mg (+/−0.5) $m2$ = SPECIMEN WITH SOIL WEIGHT $m3$ = POST-CLEANING SPECIMEN WEIGHT The cleaning performance of the cleaning solution is reported in % of the removed soil of the surface. The higher the value of the dip test result, the better the cleaning ability of the sample. In addition, a visual observation of the cleaning performance of the specimen after drying was taken under ambient conditions.

Cleaning Ability By Wet Abrasion Scrub Tester (Gardner)

Cleaning solution to be tested is poured on an artificially soiled white PVC test strip. A sponge is moved 10 times forwards and backwards. Afterwards, the test strip's whiteness is analyzed by a chromatometer.

White PVC strips (White PVC-film Benova 4812080, 1.3 m/50 m/0.12 mm as purchased from Benecke-Kaliko AG) were coated with the 2 grams of soil (IPP 83/21 available from wfk Krefeld) using a flat paintbrush with flat bristles, about 55 mm wide. The prepared strip was either (a) wiped 10 times with soil solution and allowed to dry for at least 30 minutes, or (b) wiped twice with soil solution and allowed to dry for 2-3 hours.

Two grams test soil was applied with the flat brush on the white PVC foil. Horizontal strokes were alternated with vertical strokes 7 times in each direction. The final coat was at right angles to the scouring movement. The soil was allowed to dry for one hour.

A polyester sponge submerged in water was removed from the water and allowed to drain. The sponge was compressed for 10 seconds in a sponge press and placed in a Gardner apparatus with a weight of 400 g. Twenty-five ml use or concentrated composition was poured on top of the soiled strip and the sponge. The cycle counter on the Gardner apparatus Gardner wet abrasion scrub tester apparatus model 494 (DIN-ASTM-515); supplied by Erichsen GmbH & Co. KG. was set to 10. Upon completion of the wipe cycle, the sponge was discarded. The test strip was rinsed under running deionized water. The test strips were hung for drying. Each use composition was tested on 6 strips. For comparison purposes, 6 strips were cleaned with tap water only.

The test strip's whiteness was analyzed by a Minolta Chroma Meter CR-200 chromatometer. The instrument was calibrated with the provided white tile. The reflection was taken at 7 different spots per strip. The average of the result gives the percentage of the cleanability. Single large deviating results were rejected from the calculation.

Valuation of the Results:

For the use composition and a possible comparative dilution, the average is calculated for all measurements:

$$\bar{x} = \frac{1}{N}\sum_{i=1}^{N} x_i$$

N=number of measurements (6×7=42)

x=degree of whiteness per measure spot $X_{arithm}$=Average cleaning performance Standard deviation:

$$s_X^2 := \frac{1}{N-1}\sum_{i=1}^{N}(x_i - \bar{x})^2$$

Control:

The measurements are influenced by the quality of water and the environmental conditions in the lab (temperature and humidity). Therefore, only the results achieved at once and on the same day are comparable.

The higher the Gardner Test result, the better the cleaning ability of the sample.

Wetting Behaviour Test

A 1 liter beaker was filled with 800 grams of the diluted sample to be tested. Each sample was diluted in water such that the cleaning composition had a 2% by weight concentration. A metal rack was fashioned to balance on the opening of the beaker with an arm extending into the beaker. One 30 mm cotton swatch (cotton pad) was placed on the rack. The rack was placed into the beaker. Gloves were used to handle the cotton pad so that no skin oils contaminated the pad. A stop watch was started at the moment the cotton pad touched the solution and the amount of time was measured until the cotton pad began falling from the rack. Each sample was repeated five times. The quicker the cotton pad fell, the better the wetting ability.

Example 1

The cleaning compositions shown in Table 1 above were compared using the Dip Test and the Gardner Test described above. Each formulation was diluted in tap water such that the cleaning composition had a 2% by weight concentration. Results are shown in Table 2 below:

TABLE 2

| Composition | A | B | C | D | E | F | G | H |
|---|---|---|---|---|---|---|---|---|
| Gardner | 41.2 | 44.92 | 46.11 | 46.26 | 54.73 | 54.65 | 56.02 | 50.97 |
| Dip Test | 91.33 | 82.67 | 72 | 77.33 | 72.67 | 72.73 | 83.33 | 85.06 |
| Sun cream | | | | | | | | |

The test results show that formulation G had the best cleaning ability. Formulations E, F and H also performed very well. It is interesting to note that although Sample A contained 25% of a single non-ionic surfactant, it did not perform well on both the Gardner and Dip Tests. Sample B, comprising 2 different non-ionic surfactants for a total non-ionic surfactant amount of 15% performed somewhat better than Sample A on the Gardner, but worse on the Dip Test. Samples E, F, G, and H were the preferred Samples. Samples E, F, G, and H performed the best on the Gardner Test and reasonably well on the Dip Test. Sample E, having a total non-ionic surfactant composition of only 20% struck a balance of good performance and reasonable raw material costs. While Sample G was the strongest performer in the Gardner/Dip Test combination, it was also considerably more expensive to prepare because it contained 26% non-ionic surfactant Cleaning compositions were prepared according the formulations shown in Table 3 below. These formulations include the anionic surfactant admixture. Samples L and M included citric acid to lower the pH of the composition. In preferred embodiments the pH is below about 12.

TABLE 3

| Ingredient | I | J | K | L | M |
|---|---|---|---|---|---|
| DI $H_2O$ | 59.5 | 58.5 | 54.5 | 56.7 | 52.7 |
| Lutensol TO8 | 10 | 10 | 10 | 10 | 10 |
| Plurafac LF 120 | 10 | 10 | 10 | 10 | 10 |
| Isopropanol | 5 | 5 | 5 | 5 | 5 |
| Trilon M | 5 | 5 | 5 | 5 | 5 |
| MEA | 9.5 | 9.5 | 9.5 | 9.5 | 9.5 |
| Citric Acid | — | — | — | 1.8 | 1.8 |
| Benzalkoniumchloride | 1 | 1 | 1 | 1 | 1 |
| Dye[1] | — | — | — | | |
| Absolute128[3] | — | 1 | 5 | 1 | 5 |
| pH Value | 11.33 | 10.95 | 10.63 | 10.36 | 10.30 |

[1]Eternia 0612-020 from Dullberg
[2]Tartrazine 85E102 from Kremer Pigmente GmbH & Co. KG
[3]anionic admixture from Aboleo

Example 2

Cleaning compositions I through M having formulations shown in Table 3 were compared using the Gardner Test described above. Sample I lacked the anionic surfactant admixture of the invention. Each formulation was diluted in water such that the cleaning composition had a 2% by weight concentration. Results are shown in Table 4 below:

TABLE 4

| Composition | I | J | K | L | M |
|---|---|---|---|---|---|
| Gardner diluted in tap water | 16.22 | 19.34 | 17.85 | 8.23 | 9.73 |

Test results shown in Table 4 demonstrate the improved cleaning ability of the cleaning compositions when they included the anionic surfactant admixture (Sample J) as compared to when the composition lacked the anionic surfactant admixture (Sample I). Also, the results demonstrate that no improved cleaning was imparted when the sample included 5 times the amount of anionic surfactant (see Samples J containing 1 wt % Absolute 128 vs. K containing 5 wt. % Absolute 128). As referenced above, the pH of Samples L and M was adjusted due to the inclusion of 1.8% by weight citric acid. Samples L and M performed considerably poorer than those having more alkaline pH.

Cleaning compositions were prepared according the formulations shown in Table 5 below. These formulations include at least two non-ionic surfactants along with the anionic surfactant admixture.

TABLE 5

| Ingredient | N | O | P | Q | R |
|---|---|---|---|---|---|
| DI $H_2O$ | 55.5 | 68.5 | 63.5 | 65.3 | 57.98 |
| Lutensol TO8 | 10 | 5 | 5 | 10 | 10 |
| Plurafac LF[1] 120 | 10 | 5 | 10 | 5 | 10 |
| Isopropanol | 5 | 5 | 5 | 5 | 5 |
| Trilon M | 5 | 5 | 5 | 5 | 5 |
| MEA | 9.5 | 9.5 | 9.5 | 9.5 | 9.5 |
| Benzalkonium chloride | 1 | 1 | 1 | 1 | 1 |
| Fragrance[2] | — | — | — | — | 0.5 |
| Dye[3] | — | — | — | — | 0.0016 |
| Absolute120[4] | 5 | 1 | 1 | 1 | 1 |

[1]BASF
[2]Eternia 0612-020 from Dullberg
[3]Tartrazine 85E102 from Kroner Pigmente GmbH & Co. KG & Basantol ® Rot 311 from BASF
[4]anionic admixture from Aboleo

Example 3

Cleaning compositions E, I through K, and N through R having formulations shown in Tables 2, 3 and 5 were compared using the Gardner Test and the Wetting Behavior Test described above. Each formulation was diluted in water such that the cleaning composition had a 2% by weight concentration. Results are shown in Table 6 below:

TABLE 6

| Composition | E | I | J | K | N | O | P | Q | R |
|---|---|---|---|---|---|---|---|---|---|
| Gardner diluted in hard water | 20.76 | 17.05 | 18.91 | 19.52 | 14.05 | 10.36 | 13.01 | 8.82 | 18.82 |
| Gardner diluted in tap water | 21.78 | 20.05 | 19.34 | 17.85 | 19.48 | 19.06 | 20.77 | 18.39 | 23.13 |
| Dip Test Sun Cream 2% diluted in hard water | 66.96 | 5.87 | 73.39 | 84.93 | 36.16 | 62.97 | 37.44 | 52.49 | 80.17 |
| Dip Test Sun Cream 2% diluted in tap water | 5.75 | 4.65 | 58.73 | 28.20 | 18.12 | 4.06 | 27.93 | 5.88 | 45.77 |
| Wetting behavior diluted in tap water | | | | | 1.74 | 2.16 | 1.91 | 1.96 | 1.26 |
| Wetting behavior diluted in hard water | | | | | 1.76 | 2.19 | 2.04 | 1.86 | 1.58 |

The results shown in Table 6 show that Samples J and R performed the best in the Gardner hard and tap water test and in the Dip hard and tap water tests and also showed acceptable wetting behavior results. Sample N, having 5 times the amount of anionic surfactant, did not perform better than Sample R. Samples N and R contained the same amounts of nonionic surfactants, but had varying amounts of the anionic surfactant blend. Surprisingly, Sample N performed worse than Sample R containing ⅕ the amount of anionic surfactant as compared to Sample N. Sample K performed well in both Gardner tests and in the hard water Dip test but performed poorer than J and R in the tap water Dip test. Interestingly, Sample K had 5 times the anionic surfactant admixture of samples J and R making it less desirable from an economic standpoint as it is more expensive to manufacture.

Cleaning compositions were prepared according the formulations shown in Table 7 below. These formulations alter the non-ionic surfactants and amounts along with the anionic surfactant admixture and amounts.

TABLE 7

| Ingredient | S | T | U | V |
|---|---|---|---|---|
| DI $H_2O$ | 45.5 | 59.5 | 58.5 | 58.5 |
| Lutensol TO8 | 14 | 10 | 10 | 10 |
| Plurafac LF[1] 120 | 10 | — | 10 | 10 |
| Isopropanol | 5 | 5 | 5 | 5 |
| Trilon M | 5 | 5 | 5 | 5 |
| MEA | 9.5 | 9.5 | 9.5 | 9.5 |
| Benzalkonium-chloride | 1 | 1 | 1 | 1 |
| Absolute120* | — | — | — | 1 |
| Absolute 128* | 10 | 10 | — | — |
| Absolute 129* | — | — | 1 | — |

*anionic admixture available from Aboleo

Example 4

Cleaning compositions S through V having formulations shown in Table 7 were compared using the Gardner Test and the Dip Test described above. Each formulation was diluted in water such that the cleaning composition had a 2% by weight concentration. Results are shown in Table 8 below:

TABLE 8

| Composition | S | T | U | V |
|---|---|---|---|---|
| Gardner diluted in hard water | — | — | 17.15 | 16.02 |
| Gardner diluted in tap water | — | — | 14.02 | 15.78 |
| Dip Test Sun Cream 2% | — | 56.69 | 76.3 | 88.22 |
| Dip Test Sun Cream 2% | 50.61 | — | 58.67 | 66.48 |

The results shown in Table 8 show that Sample V performed the best in the Gardner hard water dilution and the Dip Test (repeated twice). Sample U also performed well. Each of sample U and V contained 1 weight percent of the anionic surfactant blend as compared to Samples S and T. Sample S contained 10 times the amount of anionic surfactant blend as Samples U and V. Sample T lacked the second nonionic surfactant.

Storage Stability

The stability of cleaning preparations was tested according to the following methodology.

Sample V was prepared according to the formulation provided in Table 7. Five 125 ml bottles were filled with the 100 ml of the same sample formulation and stored at 50° C., 40° C., 25° C. (at 60% humidity), 0° C., −10° C./40° C. (temperature change within 12 hours), room temperature daylight, and room temperature darkness. The samples were checked every 4 weeks and depending on the sample formulation, different characteristics were measured such as pH-value, visual appearance, color, odor, and viscosity. Beyond these, visual signs for instability were noted such as flocculation, cloudiness, phasing. The samples were stored for a total of 12 weeks except that the 50° C. sample was retained for only 4 weeks storage time.

Sample V (table 7) was tested according to this method and performed very well in all different storage conditions.

Material Compatibility

Metal samples consisting of aluminum, copper, brass, chromium plated brass, Inox V2A or V4A, and zinc plated metal were degreased with isopropanol and allowed to dry. The metal samples were then weighed, taking care not to touch the sample with bare hands.

The non-metal samples such as plastic consisting of plexiglass (PMMA), polycarbonate (PC), polyacetate (PA), polypropylene (PP), PVC, and ABS were rinsed with deionized water and allowed to dry.

The cleaning compositions were diluted with tap water. Jelly jars were filled with the test cleaning compositions in a manner that allowed the samples to be covered approximately half way and the relevant sample material was placed into the test cleaning composition so that a part of the sample extended outside test composition.

The samples in test cleaning compositions were stored at ambient temperature and samples were removed after 1 week. Once removed, the samples were cleaned with deionized water and allowed to dry. The weight of the metal samples was taken to determine whether or not a change in mass occurred. Optical appearance of all samples was noted, especially whether or not a change in appearance occurred on the part of the sample that was in the test composition as compared to that portion that extended beyond the composition. Samples were returned to the jars containing the test composition for another week to yield 2 week results and then for another week to yield 3 week results. The test was completed after 3 weeks.

Results were compared against placing a sample in tap water which acted as the control.Sample V (table 7) was tested according to this method and performed very well on all different materials.

Corrosiveness Testing

Another example for good material compatibility or even, depending on the point of view, less corrosiveness can be observed when plates of copper or brass are exposed for 3 weeks to diluted cleaning compositions. Samples were prepared according to the formulations provided in Table 7 above. There was little change in the appearance of the copper and the brass plates that were put into a composition prepared according to Sample V. Thus, Sample V exhibited excellent material compatibility.

Bathroom Surfaces Cleaning Ability

Sample V was diluted with hard tap water to 2% by weight. The diluted sample V was used to clean thirty guest bathrooms in a hotel. The diluted composition/sample was sprayed from a spray bottle onto a surface and was allowed to sit for about 3 to about 5 minutes. The surfaces cleaned included ceramic tile, ceramic sinks, and plastic facial tissue holders. The soils included hydrophobic soils such as body lotions, sunscreens, body fats, baby oils and the like. After a few minutes, a synthetic sponge was used to wipe the surface.

Results were compared to Ecolab Oasis Pro cleaning product, commercially available from Ecolab, Inc. of St. Paul, Minn. Sample V outperformed the Oasis Pro product in overall cleaning performance leaving surfaces shiny and bright and leaving far fewer residues or streaks with reduced cleaning time or elbow grease required. The hydrophobic soils were removed with at least a single wipe up to about 2 wipes of the surface without requiring force to remove the soils. Overall cleaning time was reduced in that no more than one to two wipes with the sponge was required in order to substantially remove hydrophobic soils. Drying time of Sample V was also reduced as compared to the Oasis Pro product. Corrosion of surfaces did not occur with Sample V, that is, the surfaces were substantially free of corrosion.

In summary, the above evaluations show that the cleaning compositions according to the invention have good material compatibility, are minimally corrosive to metal surfaces such as steel and aluminium, but nevertheless have very good cleaning properties especially to remove water resistant creams or sunscreens.

The invention has been described with reference to various specific and preferred embodiments and techniques. However, it should be understood that many variations and modifications may be made while remaining within the spirit and scope of the invention.

We claim:

1. A single phase alkaline composition comprising by weight approximately:

(a) 2-25% of a first nonionic surfactant, (b) 2-20% of a second nonionic surfactant, (c) 3-10% of at least one water soluble solvent, (d) 1-10% of a chelant, (e) 2-12% of monoethanolamine, (f) 0.5-20% of an anionic surfactant blend comprised of:

i. 30-60% of organic solvent, and ii. 40-70% sulfosuccinicmonoalkylester represented by the general formula:

$$O_3S—CH—COOR^1—CH_2—COOR^2$$

wherein $R^1$ is comprised of a fatty alcohol, a fattyalcoholpolyglycolether, or a alkylphenylpolyglycolether or combinations thereof, and $R^2$ is comprised of H;

(g) 0.5-5% of benzalkoniumchloride; and (h) the balance being water.

2. The composition of claim 1 further comprising 0.1-1.0% perfume.

3. The composition of claim 1 further comprising 0.005-0.02% dye.

4. The composition of claim 1 wherein the chelant is comprised of a trisodium salt of methylglycinediacetic acid.

5. The composition of claim 1 wherein the water soluble solvent is comprised of isopropanol.

6. The composition of claim 1 wherein the first non-ionic surfactant is comprised of a composition represented by the general formula:

$$R^1—(OC_2H_4)_k—OH$$

wherein $R^1$ represents an unbranched or branched alkyl or alkenyl group having 1 to 10 carbon atoms and k is 1 to 10.

7. The composition of claim 1 wherein the second nonionic surfactant is comprised of a composition represented by the general formula:

$$CH_3—CH(CH_3)—(CH_2)_n—OH$$

wherein n is 6 to 14 and the composition is ethoxylated with 1-12 ethoxylate groups.

8. The composition of claim 7 wherein the second nonionic surfactant is comprised of isotridecanolethoyxylate.

9. The composition of claim 1 wherein the sulfosuccinicmonoalkylester of the general formula $O_3S—CH—COOR^3—CH_2—COOR^2$ is comprised of C8-18 and $R^2$=H.

10. The composition of claim 1 wherein the pH is between about 10 and 12.

11. The composition of claim 1 wherein the pH is between about 10.4 and 11.5.

12. A single phase alkaline composition comprising by weight:

(a) about 10 to about 25 percent of nonionic surfactant blend comprising a ratio of between about 1:1 to about 1:2 of alcohol ethoxylate: fatty alcohol alkoxylate, (b) about 3-10% of at least one water soluble solvent, (c) about 1-10% of a chelant, (d) 2-12% of an alkalinity source, (e) 0.5-2% of an anionic surfactant blend comprised of at least about 40-70% of a sulfosuccinate, (f) about 0.5-5% of benzalkoniumchloride, and (h) the balance being water.

13. The composition of claim 12 wherein the water soluble solvent is comprised of isopropanol.

14. The composition of claim 12 wherein the chelant is comprised of a trisodium salt of methylglycinediacetic acid.

15. The composition of claim 12 wherein the alkalinity source is comprised of monoethanolamine.

16. The composition of claim 12 wherein the anionic surfactant blend is comprised of a mono or dialkyl ester of the general formula:

$$O_3S—CH—COOR^1—CH_2—COOR^2$$

wherein $R^1$ is comprised of C8 to C18 and $R^2$ is comprised of H or C8-C18.

17. A single phase alkaline composition comprising by weight:

(a) about 10 percent of an alcohol ethoxylate, (b) about 10 percent of a fatty alcohol alkoxylate (c) about 5 percent of an alcohol, (d) about 5 percent of a chelant, (e) about 10 percent of an alkanolamine, (f) about 1 percent of an anionic surfactant blend comprised of at least about 40-70% of a sulfosuccinate, (g) 0.5-5% of benzalkoniumchloride, and (h) the balance being water.

18. The composition of claim 17 further comprising about 0.1-1.0% perfume.

* * * * *